US005484113A

United States Patent [19]

Watanabe

[11] Patent Number: 5,484,113

[45] Date of Patent: Jan. 16, 1996

[54] METHOD AND APPARATUS FOR WINDING WIRE AROUND A DEFLECTION YOKE

[75] Inventor: Yasuhiro Watanabe, Tokyo, Japan

[73] Assignee: Sony Corporation, Tokyo, Japan

[21] Appl. No.: 140,465

[22] Filed: Oct. 25, 1993

[30] Foreign Application Priority Data

Nov. 6, 1992 [JP] Japan ..... 4-322553

[51] Int. Cl.[6] ..... H01B 11/04; H01F 7/06

[52] U.S. Cl. ..... 242/7.03; 242/7.14; 29/605

[58] Field of Search ..... 242/7.03, 7.09, 242/7.14, 7.05 C, 1.1 R; 29/605

[56] References Cited

U.S. PATENT DOCUMENTS

| | | | |
|---|---|---|---|
| 3,879,841 | 4/1975 | Mason | 242/1.1 R X |
| 4,093,132 | 6/1978 | Christiana et al. | 242/7.03 |
| 4,946,112 | 8/1990 | Nelle et al. | 242/7.14 |
| 4,997,138 | 3/1991 | Luciani et al. | 29/605 X |
| 5,219,124 | 6/1993 | Shi et al. | 242/1.1 R |

FOREIGN PATENT DOCUMENTS 0461562 12/1991 European Pat. Off. .

0582409 2/1994 European Pat. Off. .

OTHER PUBLICATIONS

IBM Technical Disclosure Bulletin vol. 33, No. 8, Feb. 1991 entitled "Robot to Wind Stator Yoke".

*Primary Examiner*—John M. Jillions
*Assistant Examiner*—Michael R. Mansen
*Attorney, Agent, or Firm*—Ronald P. Kananen

[57] ABSTRACT

A winding apparatus for a deflection yoke comprises a nozzle for supplying a wire to be wound around the deflection yoke; and at least two guide units, each guiding the wire to a position where each winding wire is engaged with the deflection yoke. Each of the above guide units, preferably, has a function capable of being reversed by each 180°. Further, the above guide units, preferably, have a common base, and are movable crosswise by one drive unit. Additionally, the above winding apparatus, preferably, includes a drive unit for operating the nozzle in the vertical direction. With this construction, it is possible to shorten the time required for winding operation, and to reduce the production cost for the deflection yoke.

6 Claims, 23 Drawing Sheets

METHOD AND APPARATUS FOR WINDING WIRE AROUND A DEFLECTION YOKE

FIELD OF THE INVENTION

The present invention relates to a method of and apparatus for winding a wire around a winding portion of a deflection yoke mounted on a cathode-ray tube such as a Braun tube.

BACKGROUND OF THE INVENTION

Conventionally, along with demands toward high quality image and high fineness in television receivers, integral and undivided deflection yokes have been used in Braun tubes. This integral type deflection yoke has such a construction as shown in FIG. 11. An integral type deflection yoke 1 is formed in a funnel or horn shape, and has an opening portion side 1*a* and a neck side 1*b*. When the deflection yoke 1 is mounted on a Braun tube, the opening portion side 1*a* is disposed on a fluorescent screen side of the Braun tube, while the neck side 1*b* is disposed on an electron gun side of the Braun tube. The opening portion side 1*a* includes a plurality of sections 1*c*, a plurality of winding grooves 1*d*, and one opening portion side circumferential groove l*e*. Similarly, the neck side 1*b* includes a plurality of sections 1*f*, a plurality of winding grooves 1*g* and one neck side circumferential groove 1*h*.

As shown in FIGS. 12 and 13, the winding of a wire is performed for the deflection yoke 1 having the above construction in the following manner: Namely, the wire passes from the opening portion side circumferential groove 1*e* through the winding grooves 1*d* and 1*g* by way of the section 1*c*. After that, the wire passes through the neck side circumferential groove 1*h* by way of the section 1*f*. Further, the wire passes through the winding grooves 1*g* and 1*d* by way of the section 1*f*. Finally, the wire passes so as to be returned to the above opening portion side circumferential groove 1*e* by way of the section 1*c*.

In winding a wire around a winding portion of the deflection yoke 1, there may be considered such a winding apparatus as shown in FIG. 14. On a base unit 2*a*, a winding apparatus 2 has a pair of nozzle units 3 and 3, a pair of guide units 4 and 4, and one holder unit 5 and a pair of tensioner units 6 and 6. Of these units, a pair of the nozzle units 3 and 3, a pair of the guide units 4 and 4 and a pair of the tensioner units 6 and 6 are disposed so as to be symmetric and to be similar to each other, respectively. Hereinafter, only the nozzle unit 3, the guide unit 4 and the tensioner unit 6 on the left side of FIG. 14 will be described.

The above nozzle unit 3 includes a nozzle 3*a*, a nozzle turning unit 3*b* and an XZ feed unit 3*c*, and thereby it can moved in the X and Z axis directions as a whole, and also the nozzle 3*a* is turnable by a specified angle. In addition, the nozzle 3*a* is intended to feed a wire W supplied from the tensioner unit 6 through the leading edge thereof.

The guide unit 4 includes a guide operating part 4*a*, a reversing unit 4*b* and an XZ feed unit 4*c*, and thereby it can be moved in the X and Z axis directions as a whole and reversed by 180° by the reversing unit 4*b*.

The guide operating part 4*a* includes a guide claw 4*d*. The guide claw 4*d* has an L-shaped leading edge and is turnable and openable.

The tensioner 6 is mounted on a frame as shown in FIG. 14, and is intended to supply the wire from a supply source (not shown) to the nozzle unit 3 with a mechanically suitable tension.

The holder unit 5 has a holder main body 5*a* and a clamp opening/closing device 5*b* for holding the deflection yoke 1 as shown in FIG. 11, and which can index the turning angle. Thus, the deflection yoke 1 is mounted on the holder main body 5*a* and is supported so as to be turnable by a specified angle.

The winding of the wire is performed for the deflection yoke 1 using the winding apparatus 2 having the above construction in such a manner as shown in FIGS. 15 to 32.

First, as shown in FIG. 15, a pair of the nozzles 3*a* and 3*a* are descended in the deflection yoke 1, and two wires W are bound and fixed to two sections if and if on the neck side 1*b*. At this time, a pair of the guide claws 4*d* and 4*d* are horizontally positioned on the sides of the opening portion 1*a*.

Next, as shown in FIGS. 16 and 17, as the deflection yoke 1 is turned while a pair of nozzles 3*a* and 3*a* are ascended, the wires are supplied from the nozzles 3*a* and 3*a* along the winding grooves 1*d* and 1*d*. In addition, FIG. 17 briefly shows only one nozzle 3*a*.

As shown in FIGS. 18 and 19, when the nozzles 3*a* and 3*a* are moved to positions higher than the opening portion 1*a* of the deflection yoke 1, they are stopped at the positions and are each turned by plus 180° . Then, the guide claws 4*d* and 4*d* advance in the open states and are closed to catch the wires W. Thus, the wires W are moved to the positions corresponding to the opening side circumferential groove 1*e*.

Subsequently, the deflection yoke 1 is turned, and is stopped at the sections 1*c* and 1*c* to be wound with the wires. At this time, as shown in FIGS. 20 and 21, the guide claws 4*d* and 4*d* advance so as to correspond to the positions of the opening side circumferential groove 1*e*, and enter within the opening side circumferential side groove 1*e*. The nozzles 3*a* and 3*a* are then moved to the inner side of the deflection yoke 1 and are turned by minus 180° to be thus returned to the original positions. Then, by opening of the guide claws 4*d* and 4*d*, the wires W are wound around the target sections 1*c* and 1*c*.

Next, as shown in FIGS. 22 and 23, the nozzles 3*a* and 3*a* are descended while supplying the wires W. Synchronously with the descending of the nozzles 3*a* and 3*a*, the deflection yoke 1 is turned. Accordingly, the nozzles 3*a* and 3*a* are descended along the arbitrary winding grooves 1*d* and 1*d*. On the other hand, the guide claws 4*d* and 4*d* are started to be moved directly after the above opening motion. Thus, when reaching the positions as shown in FIG. 24, the guide claws 4*d* and 4*d* are reversed by 180° and wait the descending of the nozzles 3*a* and 3*a* at the positions on the neck side 1*b*.

As shown in FIG. 24, when the nozzles 3*a* and 3*a* descended along the winding grooves 1*d* and 1*d* and reach the minimum points, the guide claws 4*d* and 4*d* advance and are closed to catch the wires W. The guide claws 4*d* and 4*d* are retreated in the state of catching the wires W and are ascended, and as shown in FIGS. 25 and 26, when reaching the positions of the neck side circumferential groove 1*h*, they are stopped. In such a state, as shown in FIGS. 27 and 28, the deflection yoke 1 is turned and stopped at the position corresponding to the sections 1*f* and 1*f* to be wound with the wires.

At this time, as shown in FIGS. 29 and 30, the guide claws 4*d* and 4*d* advance while being in the positions of the neck side circumferential groove 1*h*, and enter within the neck side circumferential groove 1*h*. Then, by opening of the guide claws 4*d* and 4*d*, the winding is performed for the target sections 1*f* and 1*f*.

After that, as shown in FIG. 31, the guide claws 4*d* and 4*d* are retreated and ascended, and further are reversed. Further, as shown in FIG. 32, the nozzles 3*a* and 3*a* are ascended again just as shown in FIG. 17. Thus, the guide claws 4*d* and 4*d* can smoothly catch the wires W and guide them. By repeating of the operational procedure of one cycle described above, the winding of the wires W are performed for the deflection yoke 1.

In the winding apparatus having the above construction, however, the opening portion side 1*a* and the neck side 1*b* of the deflection yoke 1 are relatively apart from each other in the vertical direction. Since the guide claw 4*d* is intended to be suitably moved in the vertical direction for winding operation in the directions of the opening portion side 1*a* and the neck side 1*b*, the time required for the movement of the guide claw 4*d* becomes longer, which takes a longer time for the winding operation. Accordingly, the production of the deflection yoke for unit time is reduced. This causes a disadvantage in increasing the cost of the deflection yoke, resulting in the increased cost of the Braun tube or the television receiver.

SUMMARY OF THE INVENTION

Accordingly, an object of the present invention is to provide a method and an apparatus for winding a wire around a deflection yoke, which is capable of shortening the time required for winding operation, and of reducing the production cost of the deflection yoke.

The above object can be achieved, according to the present invention, by provision of an apparatus for winding a wire around a deflection yoke comprising guide means which, in the case that portions of the members to be wound with the wire, constituting the deflection yoke, are apart from each other, guide the wire to the portions to be wound with the wire.

Preferably, the guide means have a function capable of being reversed by each 180°.

According to the above construction, in the case that the portions to be wound with wires, for example, the opening portion side and the neck side of the deflection yoke, are vertically apart from each other, since one guide means is provided for each portion to be wound with the wire, the winding operation is performed for one portion to be wound with the wire while the wire is guided by the guide means provided for the portion to be wound with the wire; and the winding operation is performed for the other portion to be wound with the wire while the wire is guided by the next guide means without the above guide means.

Further, in the case that each of the above guide means has a function capable of being reversed by each 180°, two kinds of winding operations, normal winding and reversed winding, can be continuously performed by use of the same guide means.

Consequently, according to the present invention, since the movement of the guide means is eliminated when the winding is shifted from one portion to be wound with the wire to another portion to be wound with the wire in the continuous winding operation, it is possible to shorten the winding time. This makes it possible to increase the production of the deflection yoke resulting in the reduced production cost of the deflection yoke, and hence to reduce the cost of the Braun tube and the television receiver. Further, in the case that each of the above guide means has a function capable of being reversed by each 180°, it is possible to continuously perform two kinds of winding operations, that is, normal winding and reversed winding, and hence to more effectively perform the winding operation.

DETAILED DESCRIPTION OF THE PREFERRED EMBODIMENTS

Figure 1:
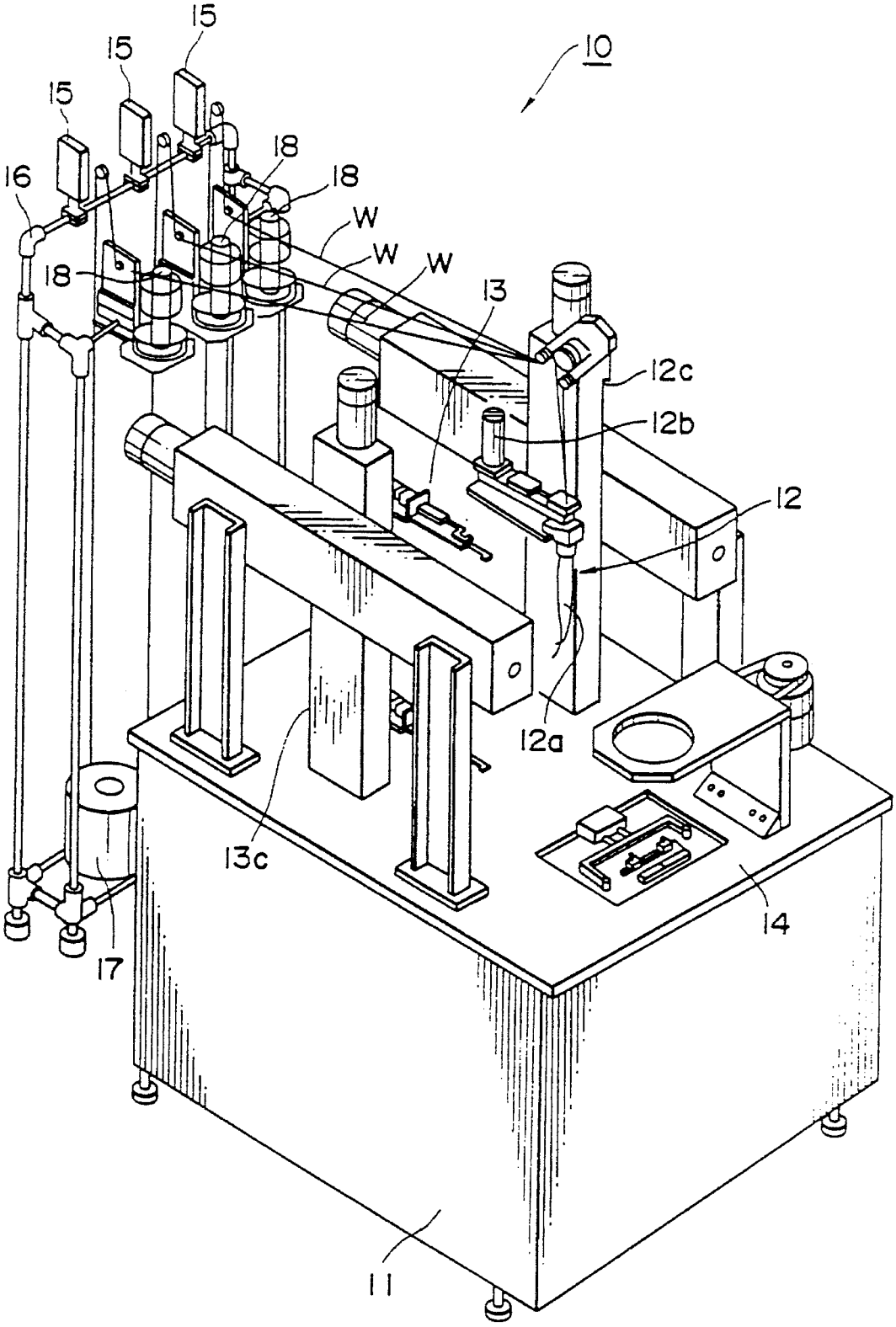
FIG. 1 is a schematic perspective view showing one embodiment of a winding apparatus according to the present invention.

Hereinafter, the preferred embodiments of the present invention will be described in detail with reference to FIGS. 1 to 10. FIG. 1 shows one embodiment of a winding apparatus for a deflection yoke of the present invention. On a base unit 11, a winding apparatus 10 has one nozzle unit 12, a guide unit 13 with two guides, one holder unit 14 and three tensioner units 15.

Figure 14:
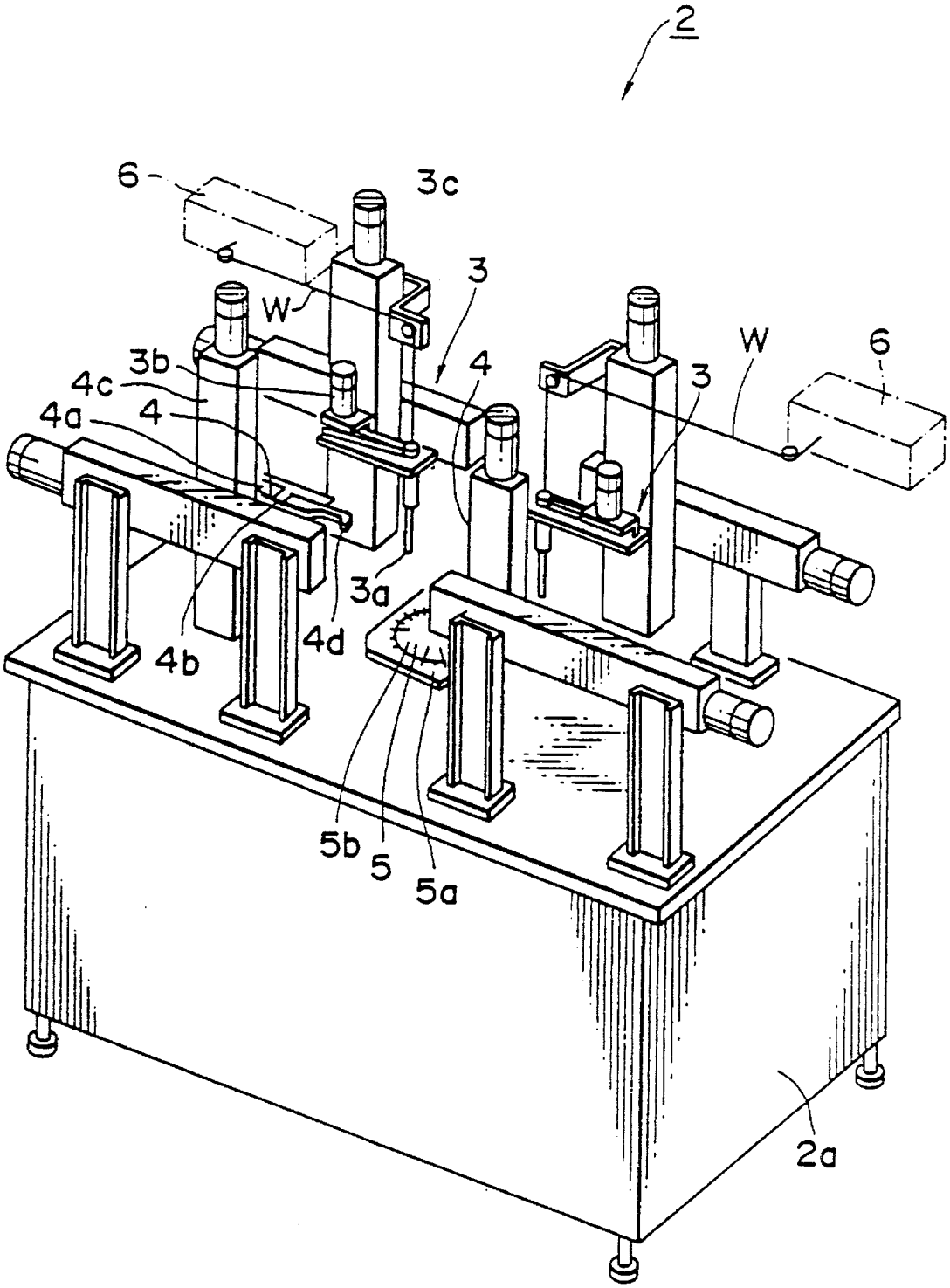
FIG. 14 PRIOR ART
FIG. 14 is a schematic perspective view showing one example of a winding apparatus for a deflection yoke different from the present invention.
Figure 15:
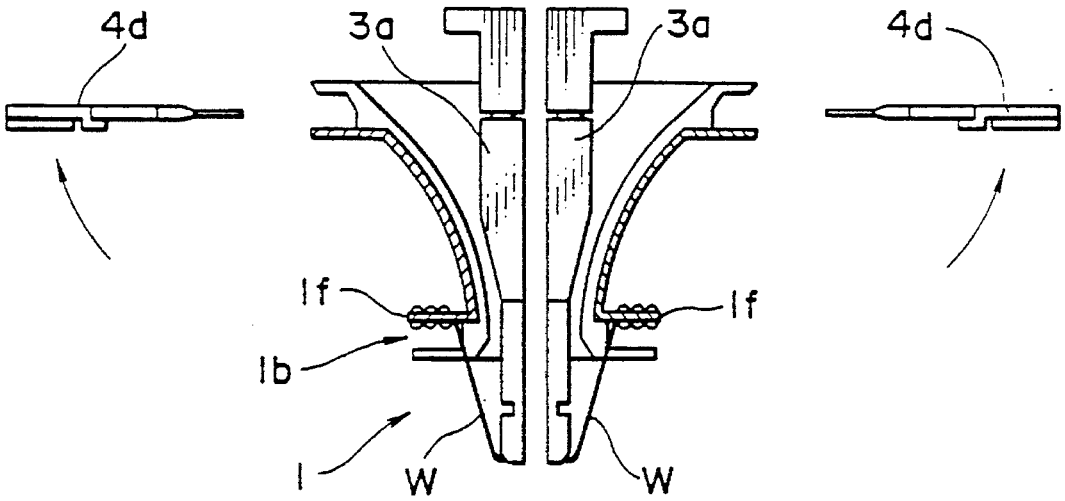
FIG. 15 PRIOR ART
FIG. 15 is a view showing the state of starting the winding of the wires by the winding apparatus of FIG. 14.
Figure 16:
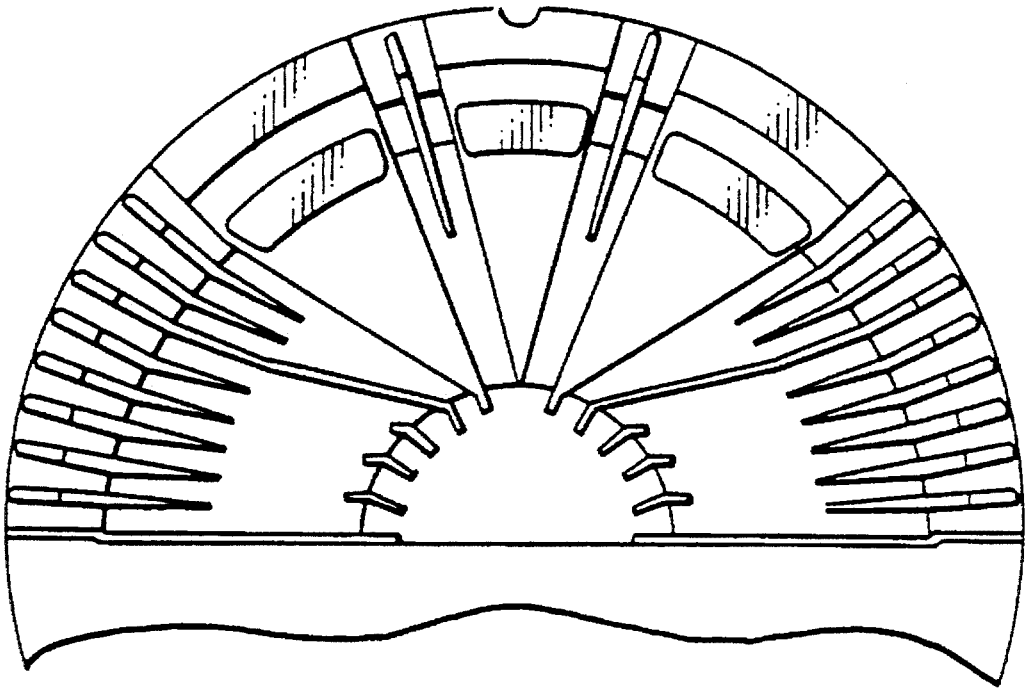
FIG. 16 PRIOR ART
FIG. 16 is a bottom view showing the state where the wire is guided in the deflection yoke.
Figure 17:
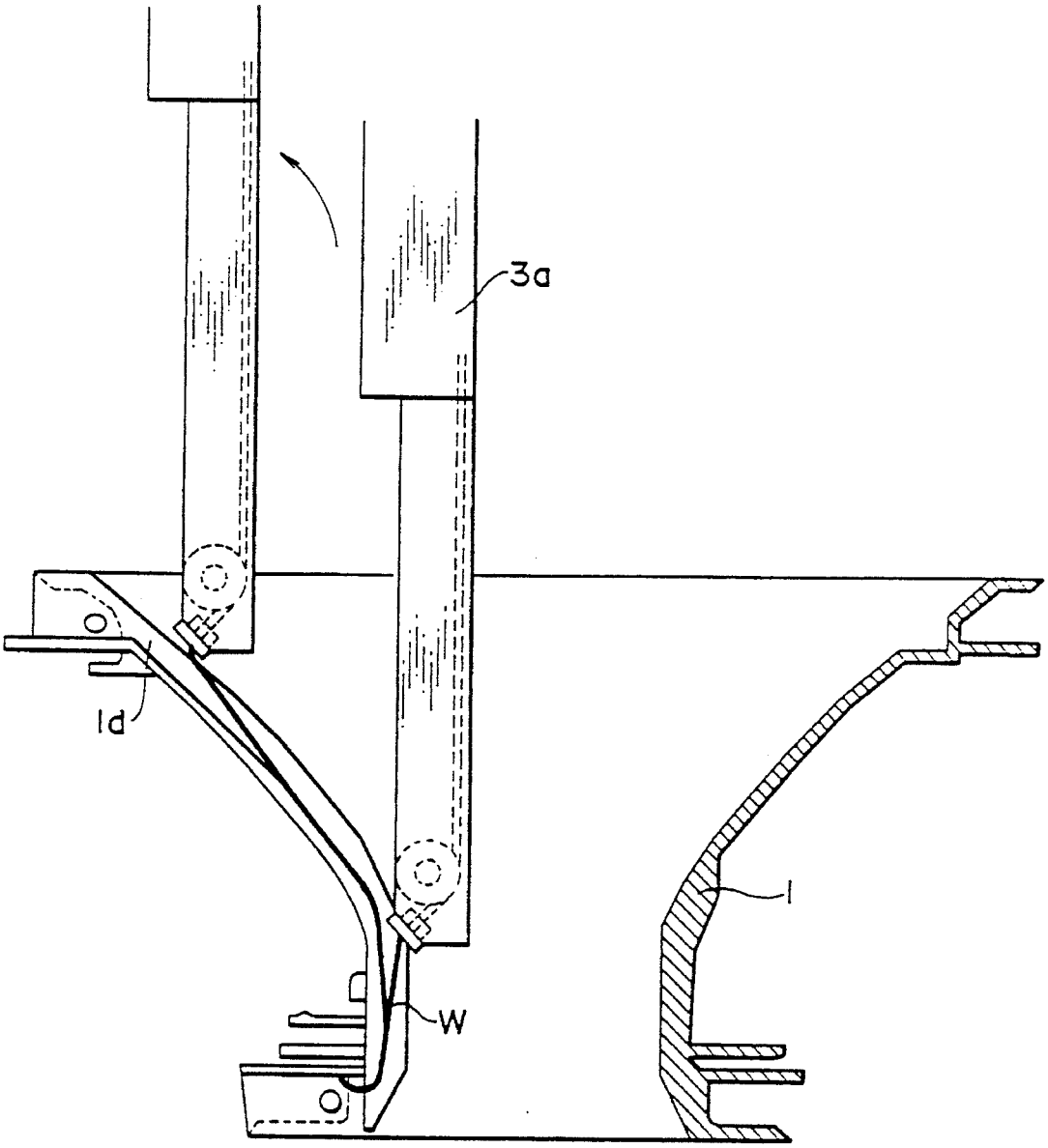
FIG. 17 PRIOR ART
FIG. 17 is a sectional view showing the state where the wire is guided in the deflection yoke.
Figure 18:
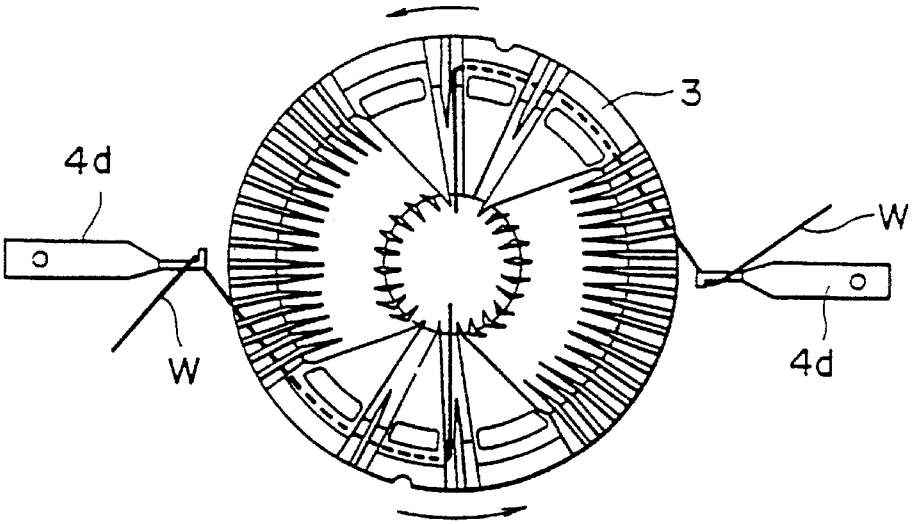
FIG. 18 PRIOR ART
FIG. 18 is a bottom view showing the state where the wires are wound around the opening side circumferential groove of the deflection yoke.
Figure 19:
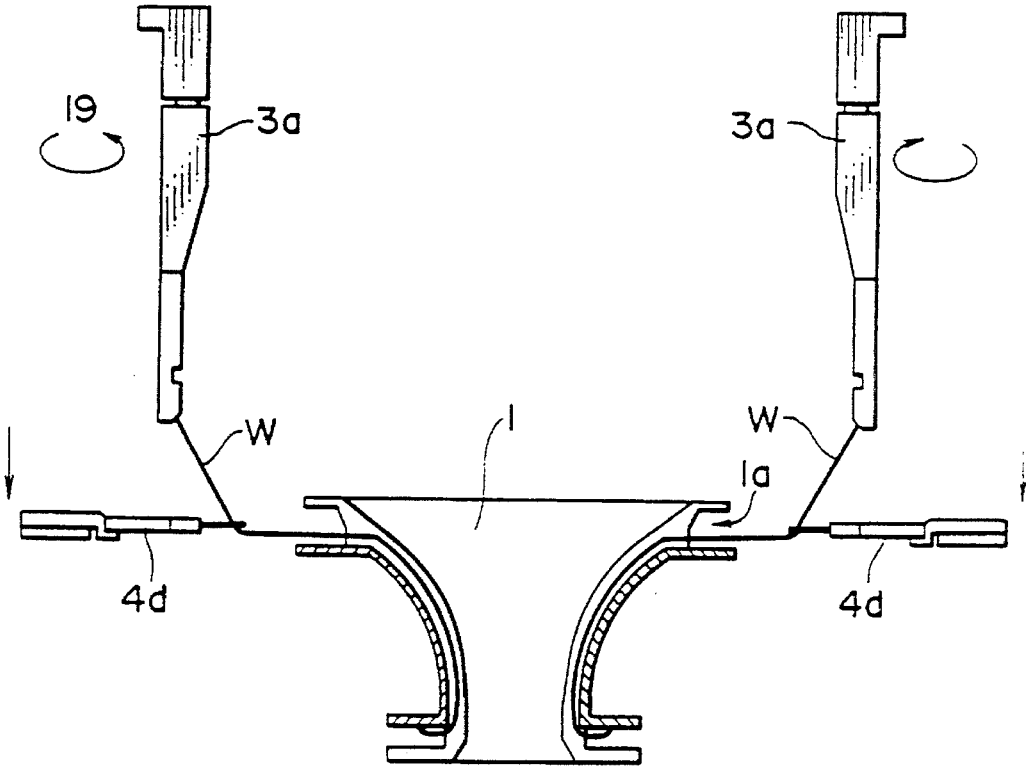
FIG. 19 PRIOR ART
FIG. 19 is a sectional view showing the state where the wires are wound around the opening side circumferential groove of the deflection yoke.
Figure 20:
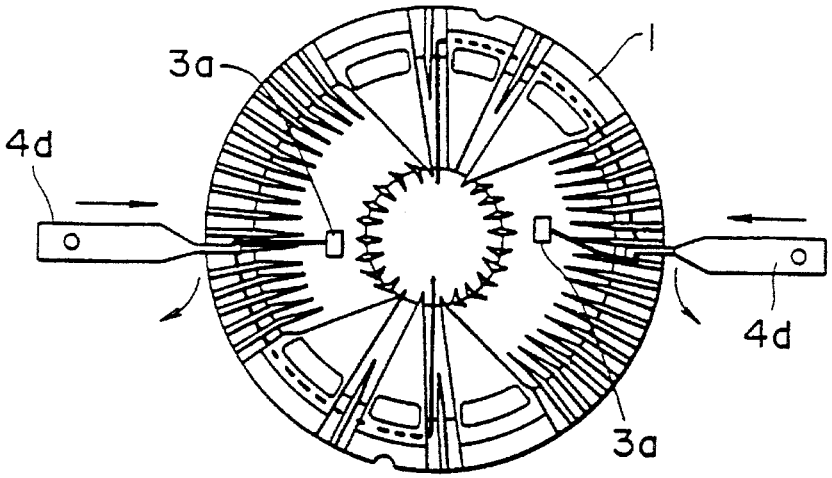
FIG. 20 PRIOR ART
FIG. 20 is a bottom view showing the state where the wires are wound around certain sections.
Figure 21:
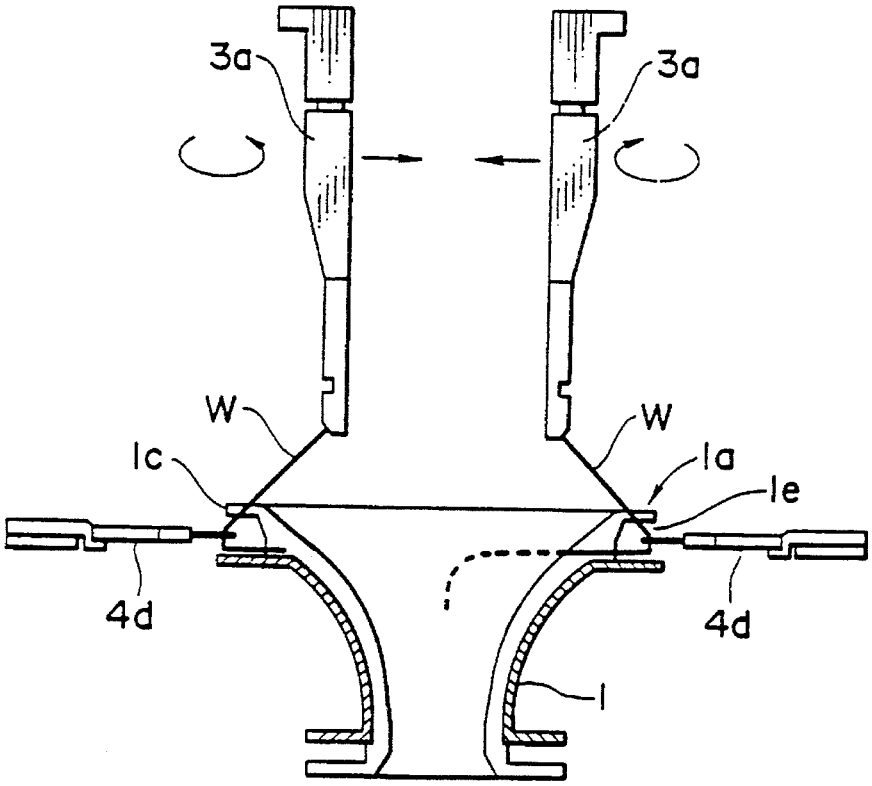
FIG. 21 PRIOR ART
FIG. 21 is a sectional view showing the state where the wires are wound around the certain sections.
Figure 22:
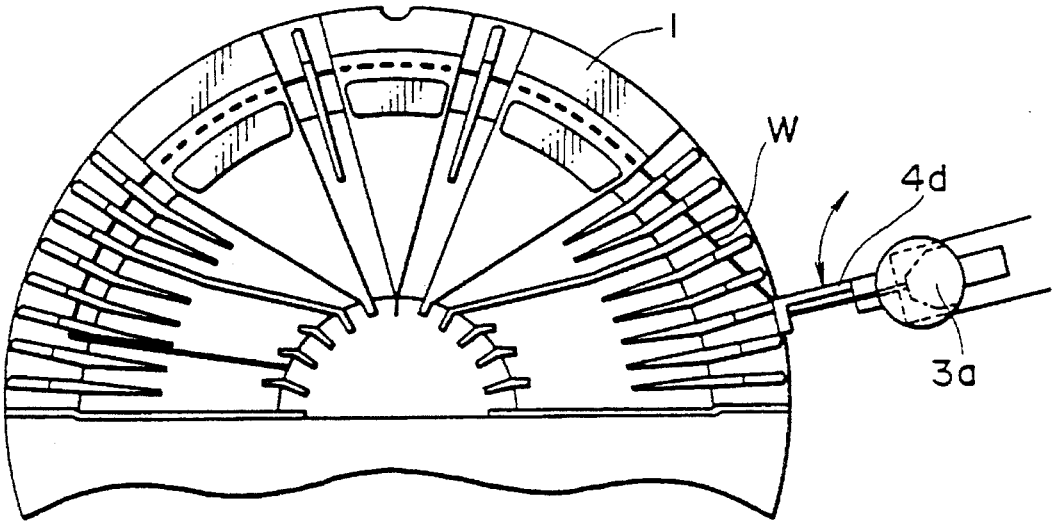
FIG. 22 PRIOR ART
FIG. 22 is a bottom view showing the state where the wires are wound around the opening side circumferential groove and are introduced on the neck side by way of winding grooves.
Figure 23:
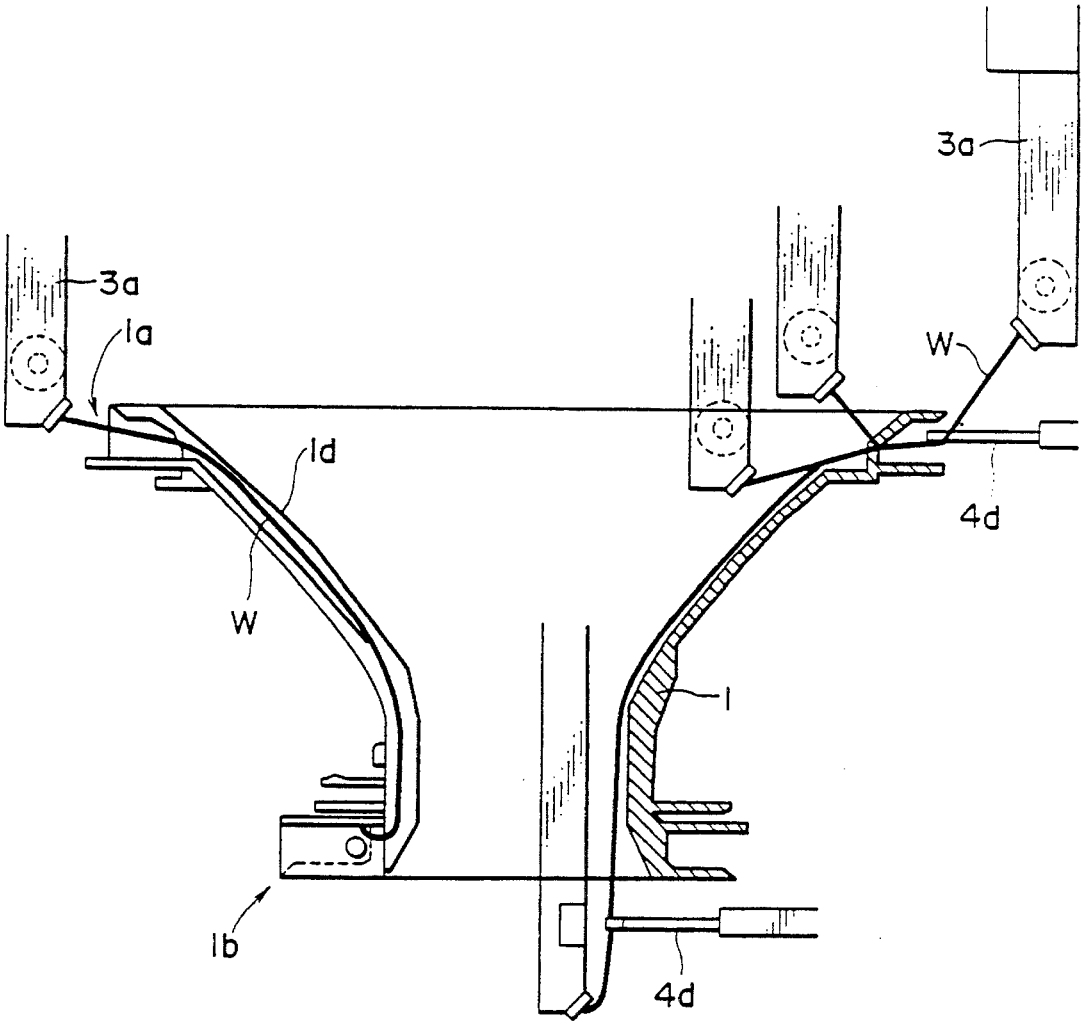
FIG. 23 PRIOR ART
FIG. 23 is a sectional view showing the state where the wires are wound around the opening side circumferential groove and are introduced on the neck side by way of the winding grooves.
Figure 24:
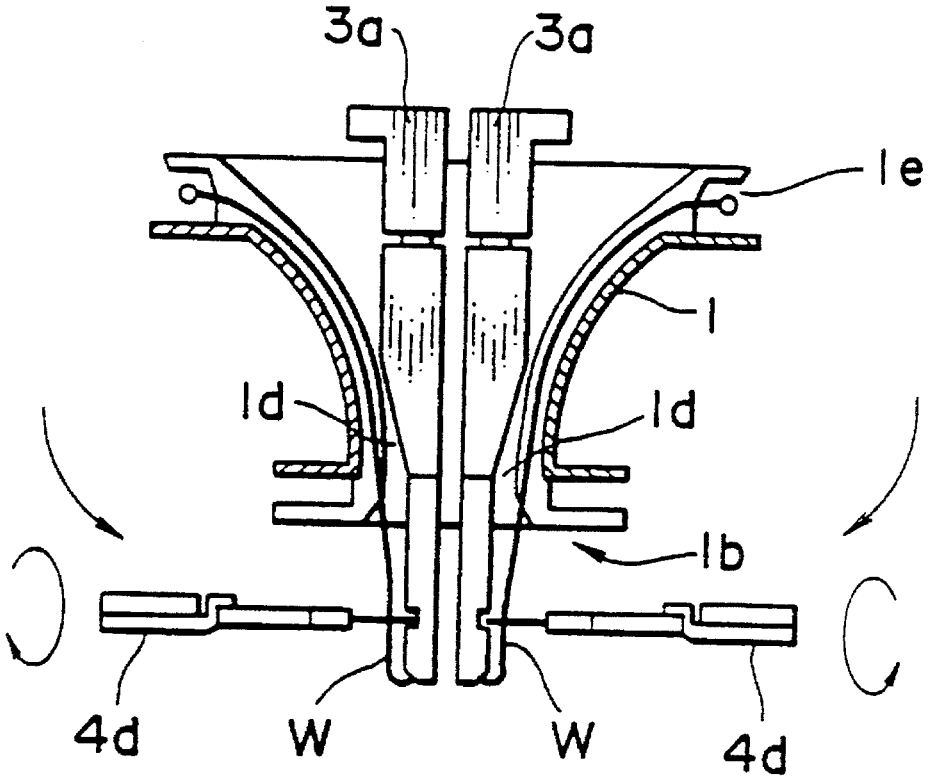
FIG. 24 PRIOR ART
FIG. 24 is a sectional view showing the state where the wires are caught by guide claws on the neck side.
Figure 25:
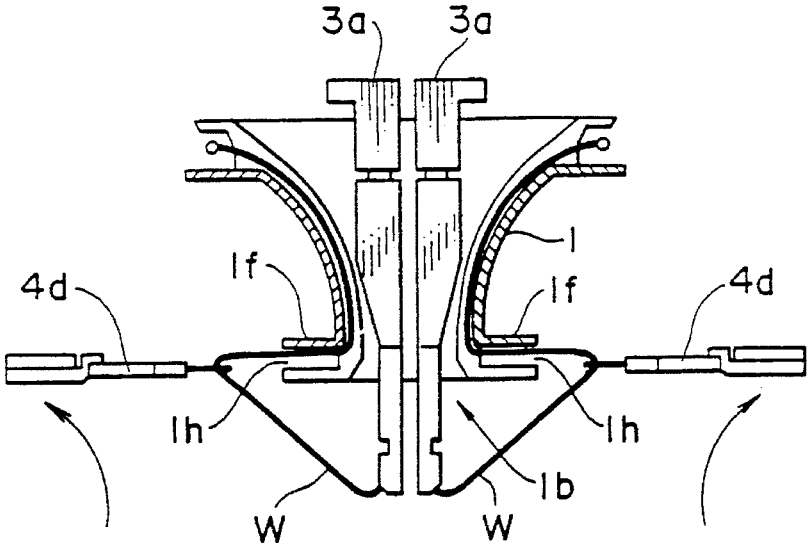
FIG. 25 PRIOR ART
FIG. 25 is a sectional view showing the state where the wires are introduced to the positions corresponding to the neck side circumferential groove by the guide claws on the neck side.
Figure 26:
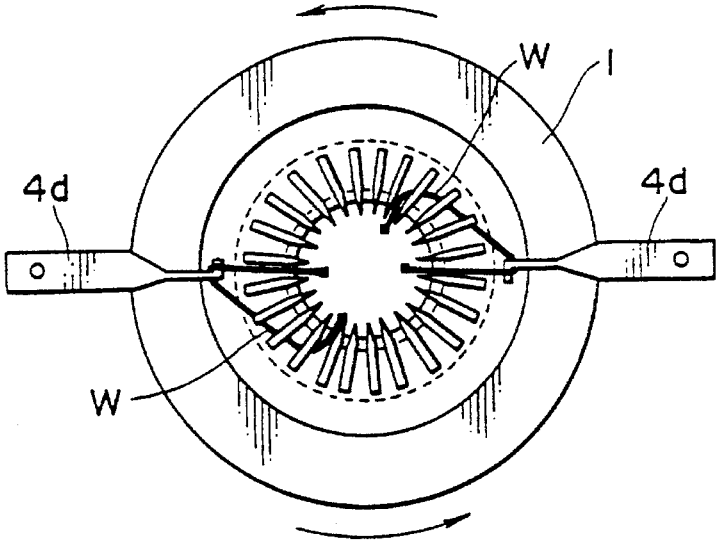
FIG. 26 PRIOR ART
FIG. 26 is a bottom view showing the state where the wires are introduced to the positions corresponding to the neck side circumferential groove by the guide claws on the neck side.
Figure 27:
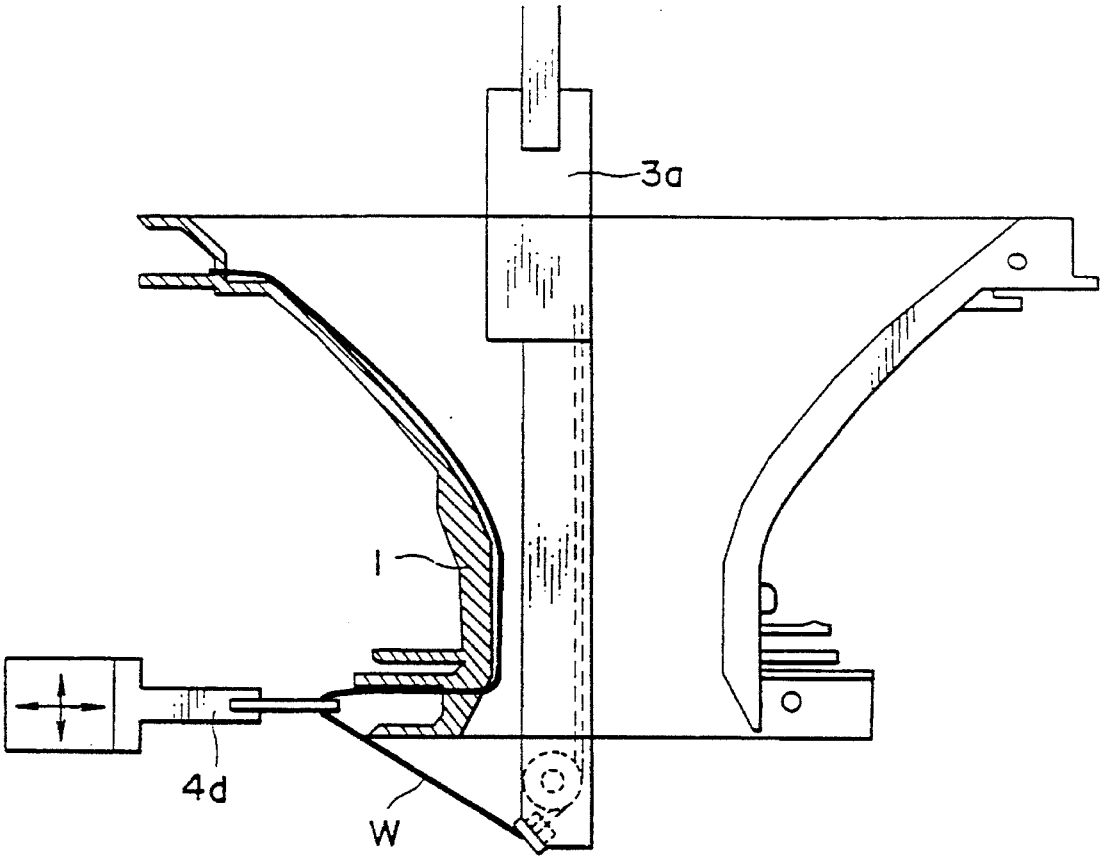
FIG. 27 PRIOR ART
FIG. 27 is a sectional view showing the state where the wire is further drawn at the position corresponding to the neck side circumferential groove by the guide claw on the neck side.
Figure 28:
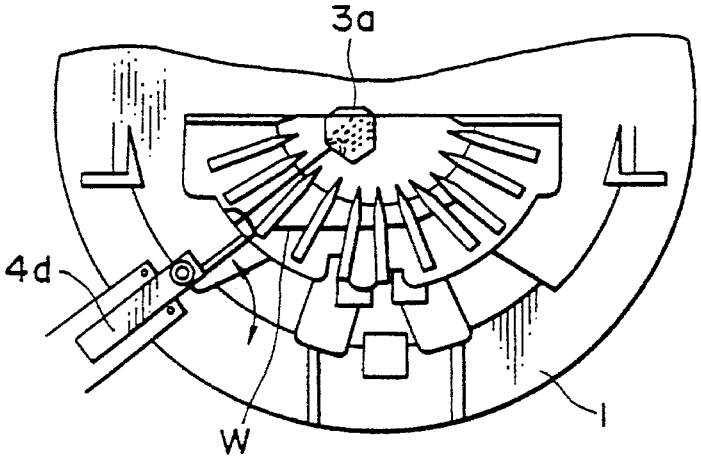
FIG. 28 PRIOR ART
FIG. 28 is a bottom view showing the state where the wire is further drawn at the position corresponding to the neck side circumferential groove by the guide claw on the neck side.
Figure 29:
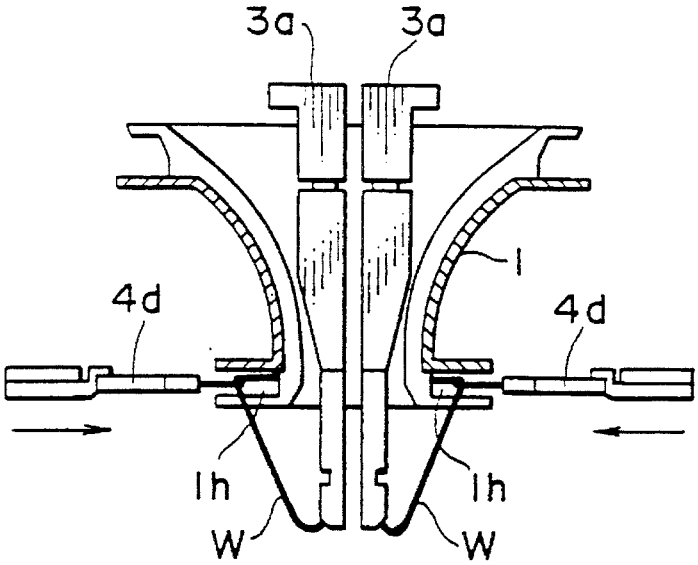
FIG. 29 PRIOR ART
FIG. 29 is a sectional view showing the state where the wires enter in the neck side circumferential groove by the guide claws on the neck side.
Figure 30:
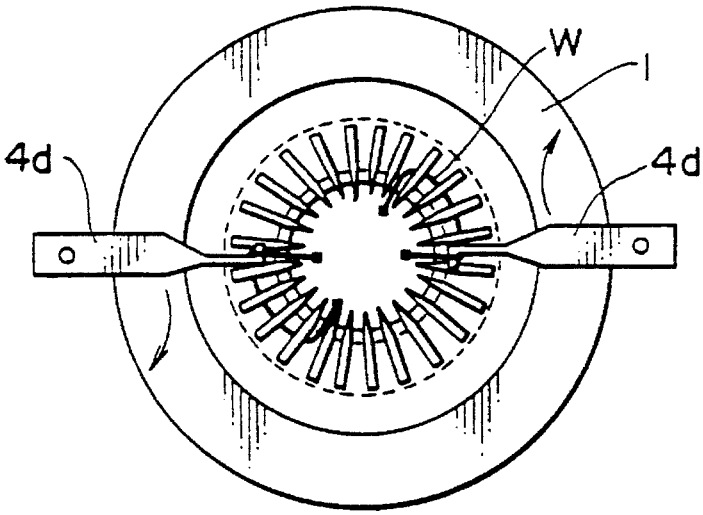
FIG. 30 PRIOR ART
FIG. 30 is a bottom view showing the state where the wires enter in the neck side circumferential groove by the guide claws on the neck side.
Figure 31:
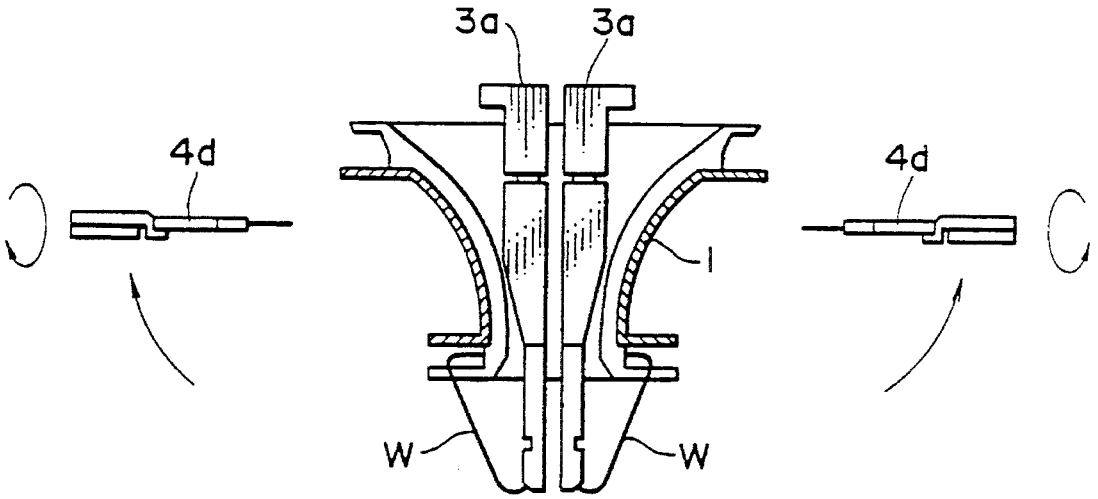
FIG. 31 PRIOR ART
FIG. 31 is a sectional view showing the state where the nozzles for the wires are held on the neck side.
Figure 32:
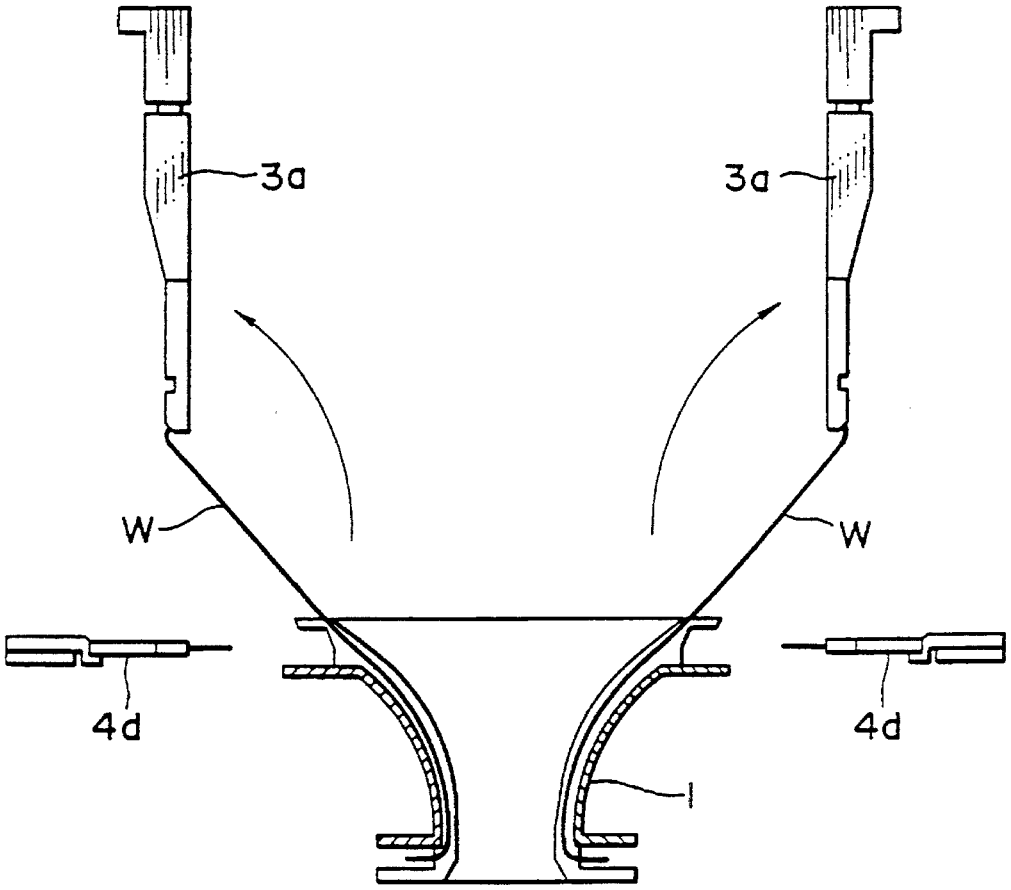
FIG. 32 PRIOR ART
FIG. 32 is a sectional view showing the state where the nozzles for the wires are ascended on the opening portion side and are shifted to the next winding cycle.

The above nozzle unit 12, similarly to the prior art winding apparatus as shown in FIG. 14, includes a nozzle 12*a*, a nozzle turning unit 12*b* and an XZ feed unit 12*c*, and thereby it can be moved in the X and Z axis directions as a whole, and also the nozzle 12*a* is turnable by a specified angle. In addition, the nozzle 12*a* is intended to feed the wire W supplied from the tensioner unit 15 through the leading edge thereof.

The guide unit 13 includes a pair of guide operating parts 20 and 21, a pair of reversing units 22 and 23 and one XZ feed unit 25.

Figure 2A:
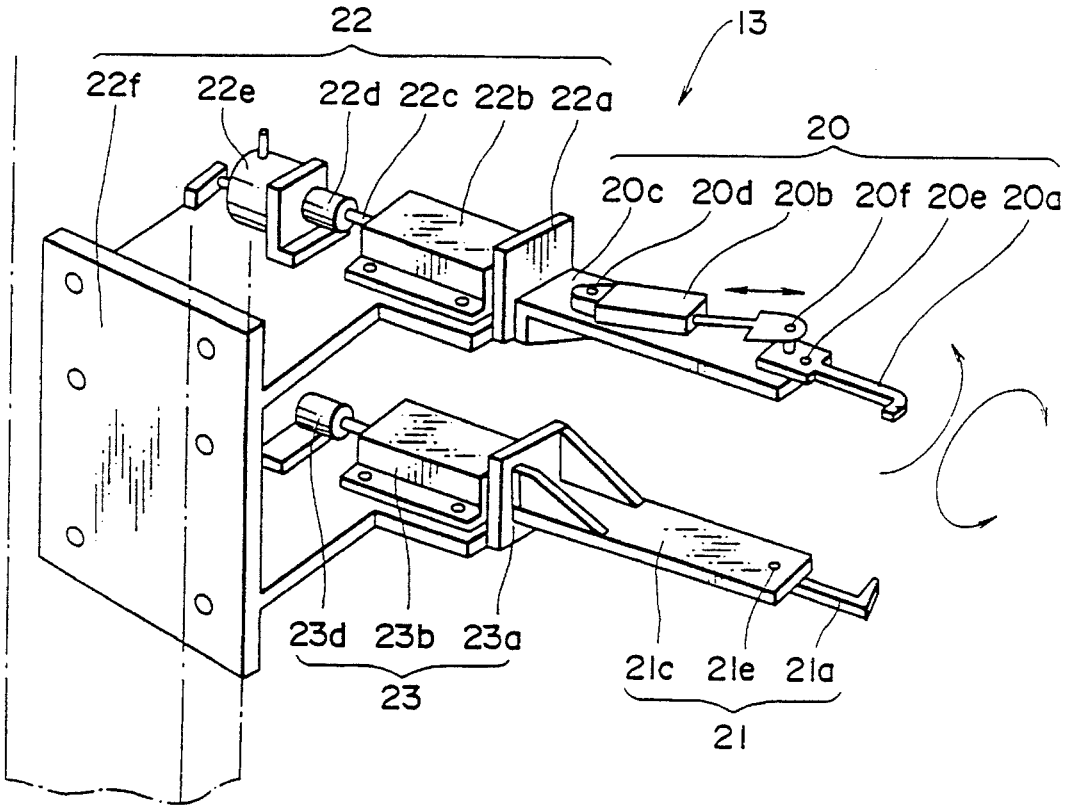
FIGS. 2A to 2C are a schematic perspective view showing a guide unit of the winding apparatus in FIG. 1.
Figure 2B:
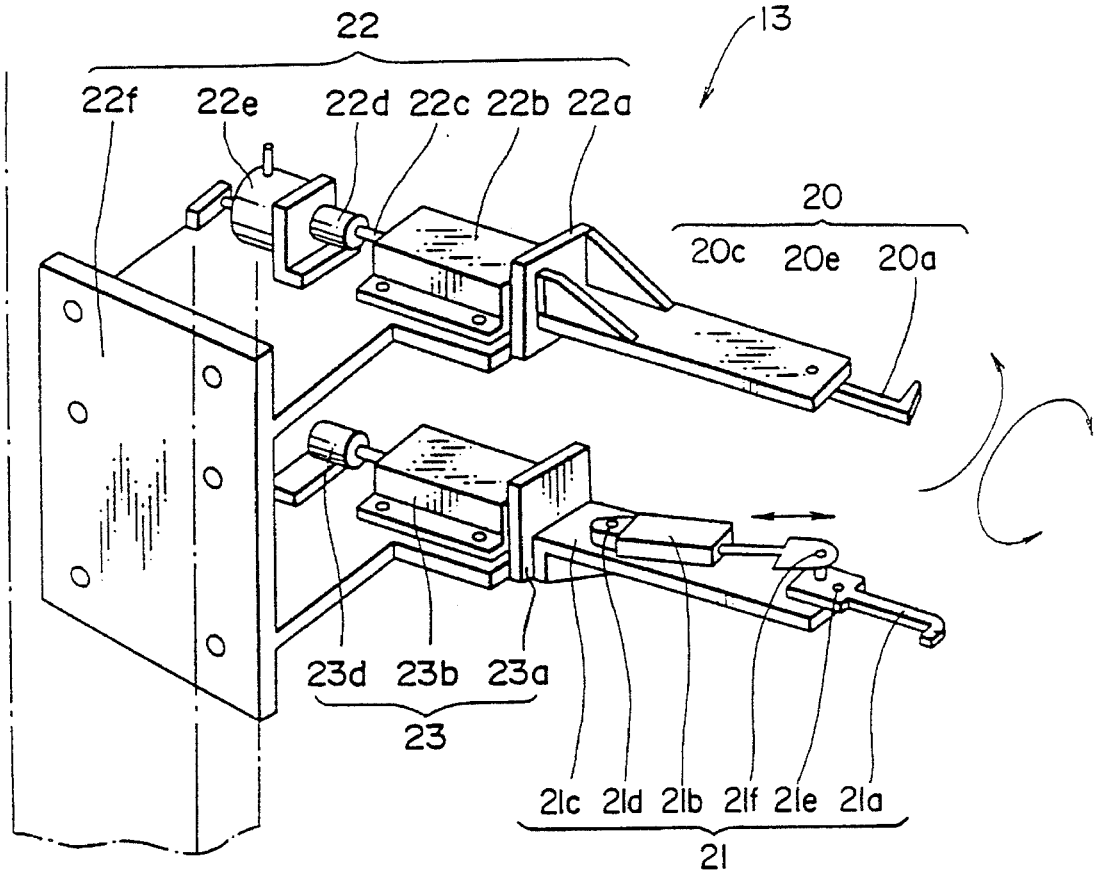
Figure 2C:
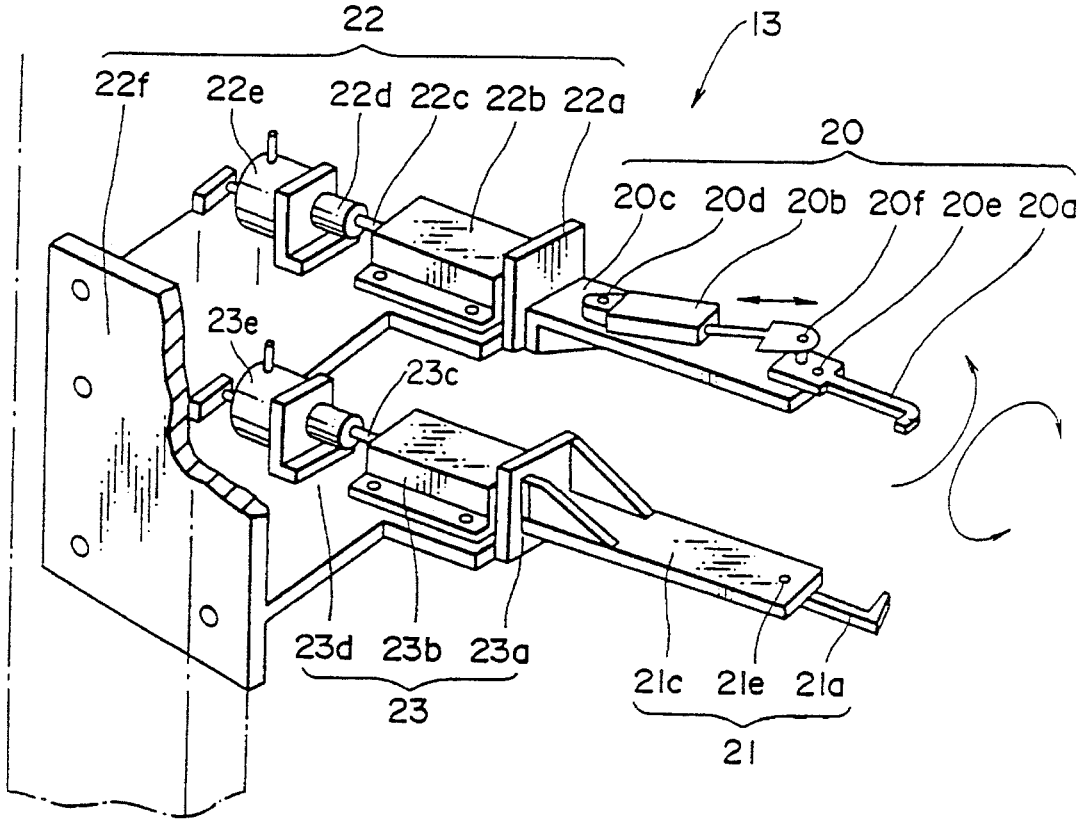

FIGS. 2A to 2C shows the guide operating parts 20 and 21 and the reversing units 22 and 23 of the guide unit 13. The guide operating units 20 and 21 have the guide claws 20*a* and 21*a*, opening/closing cylinders 20*b* and 21*b*, and bases 20*c* and 21*c*, respectively. The rear portions of the bases 20*c* and 21*c* are respectively connected to the rear portions of the opening/closing cylinders 20*b* and 21*b* by means of pins 20*d* and 21*d*.

Figure 3:
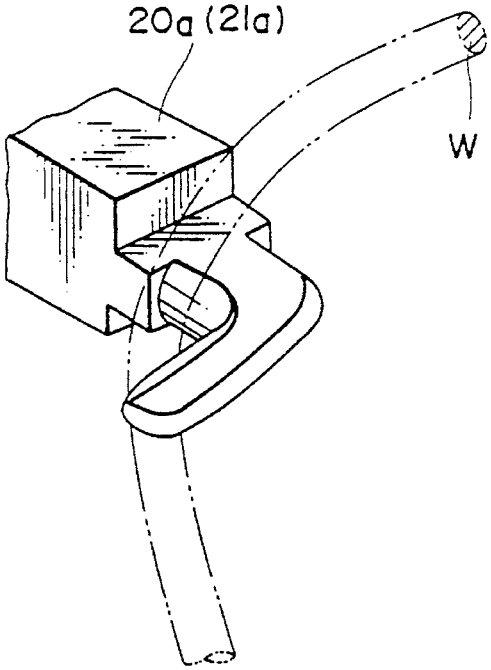
FIG. 3 is a partially enlarged perspective view showing the vicinity of the leading edge of a guide claw of the guide unit of FIG. 2.

The front portions of the bases 20*c* and 21*c* are respectively connected to the guide claws 20*a* and 21*a* by means of pins 20*e* and 21*e*. In addition, the shafts of the opening/closing cylinders 20*b* and 21*b* are respectively connected to the guide claws 20*a* and 21*a* by means of pins 20*f* and 21*f*. With this arrangement, when the shafts of the opening/closing cylinders 20*b* and 21*b* are retreated, the guide claws 20*a* and 21*a* are turned around the pins 20*e* and 21*e*, to be thereby opened, respectively. On the other hand, when the shafts of the opening/closing cylinders 20*b* and 21*b* advance, the guide claws 20*a* and 21*a* are turned around the pins 20*e* and 21*e*, to be thereby closed, respectively. In addition, preferably, the guide claws 20*a* and 21*a* have L-shaped leading edges, respectively, as shown in FIG. 3.

The reversing units 22 and 23 include reversing bases 22*a* and 23*a*, bearing housings 22*b* and 23*b*, reversing shafts 22*c* and 23*c*, couplings 22*d* and 23*d*, rotary actuators 22*e* and 23*e* and a slide base 22*f*. When the rotary actuators 22*e* and 23*e* are turned by 180° by air pressure, the reversing shafts 22*c* and 23*c* and the reversing bases 22*a* and 23*a* connected to each other by means of the couplings 22*d* and 23*d* are turned by 180°, and the guide claws 20*a* and 21*a* are respectively reversed together with the above bases 20*c* and 21*c*.

Figure 4:
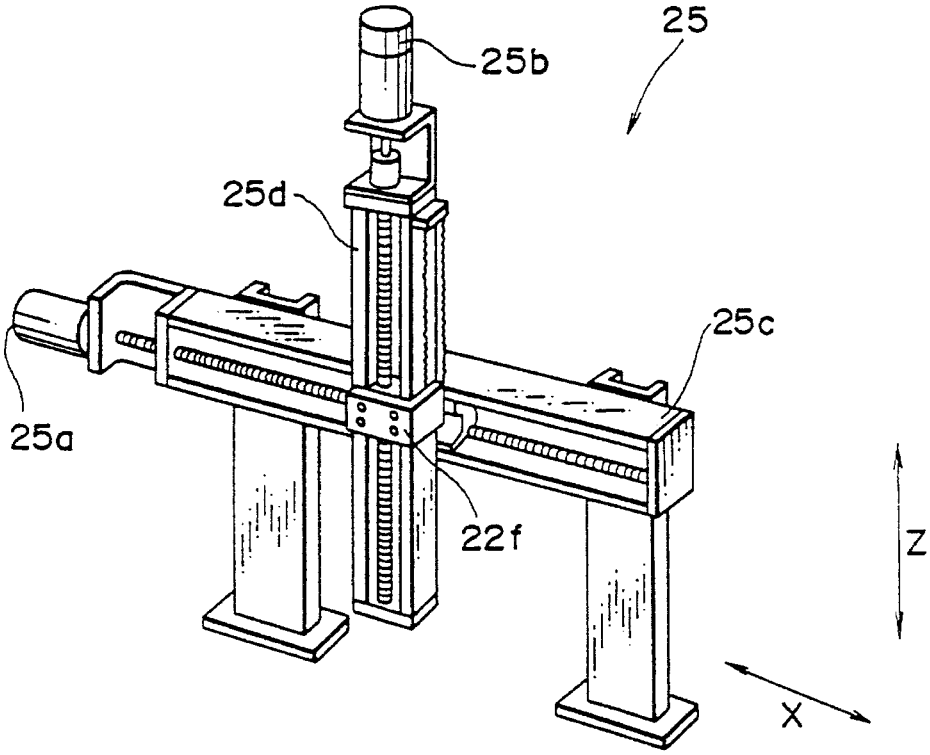
FIG. 4 is a schematic perspective view of an XZ feed unit of the guide unit in the winding apparatus of FIG. 1.

Further, as shown in FIG. 4, the XZ feed unit 25 includes an AC servo-motors 25*a* and 25*b*, ball screw driven slide units 25*c* and 25*d*. By turning of the above AC servo-motors 25*a* and 25*b*, the slide base 22*f* is moved in the longitudinal and vertical directions. Here, since the above AC servo-motors 25*a* and 25*b* are turned by the number of the supplied pulses, by control of the number of the pulses, the slide units 25*c* and 25*d* can be moved to the suitable positions.

Further, the tensioner unit 15 is mounted to a frame 16 as shown in FIG. 1, which is intended to supply the wire W from a wire reel 17 to the nozzle unit 12 with a mechanically suitable tension by way of a paraffin coating unit 18.

In addition, the holder unit 14 has a holder main body 14*a* and a clamp opening/closing device 14*b*, which is intended to hold the deflection yoke by the holder main body 14*a* and clamp the deflection yoke by closing of the clamp opening/closing device 14*b*.

Figure 9:
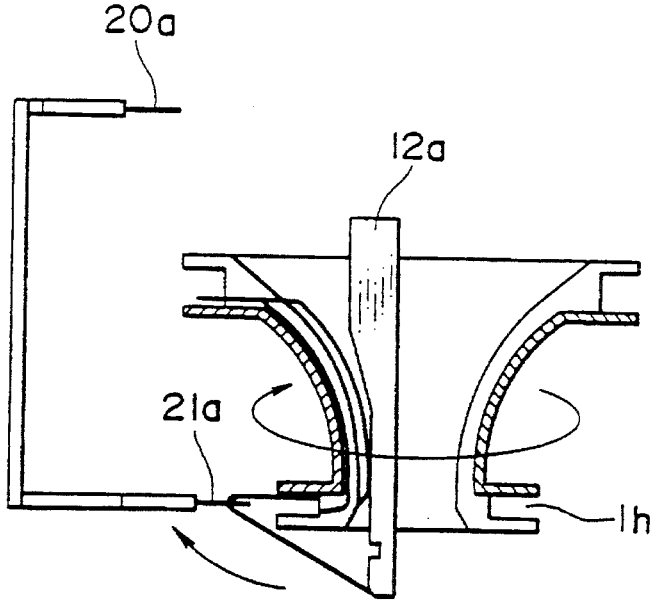
FIG. 9 is a sectional view showing the state where the wire is introduced to the position corresponding to the neck side circumferential groove by the guide claw on the neck side.
Figure 10:
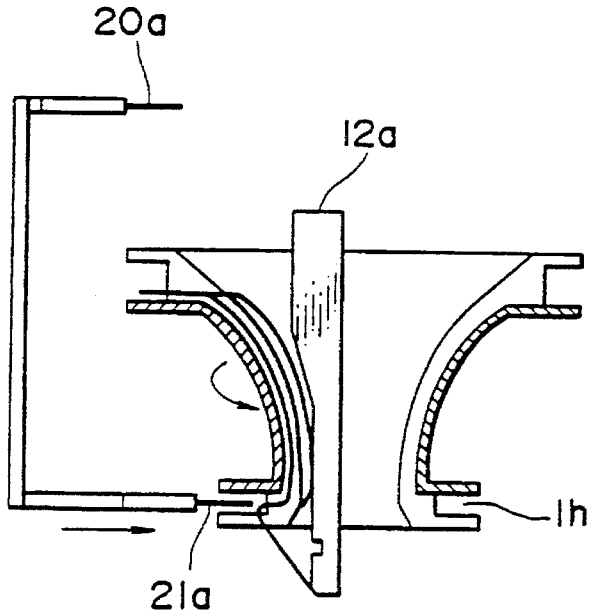
FIG. 10 is a sectional view showing the state where the wire enters in the neck side circumferential groove by the guide claw on the neck side.
Figure 11:
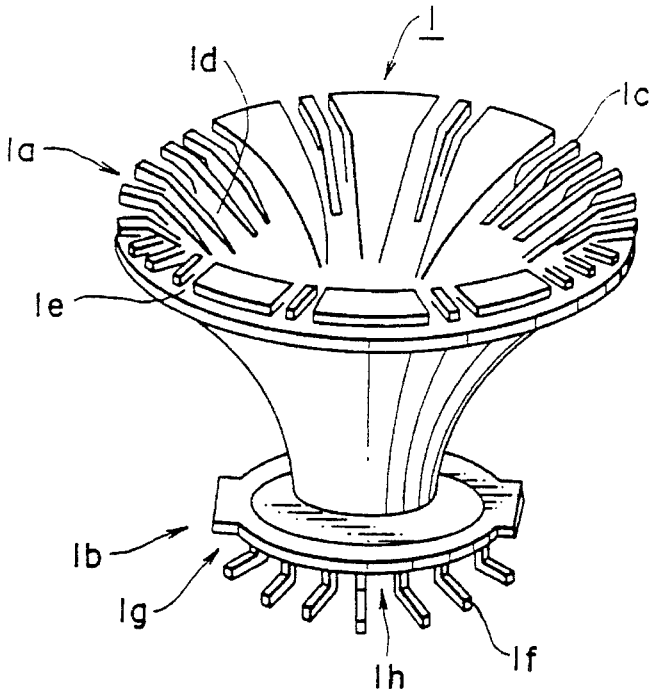
FIG. 11 PRIOR ART
FIG. 11 is a perspective view showing a construction of an integral deflection yoke.
Figure 12:
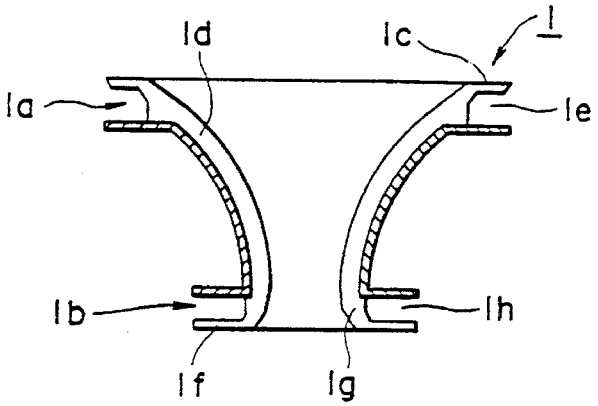
FIG. 12 PRIOR ART
FIG. 12 is a sectional view showing a construction of an integral deflection yoke.
Figure 13:
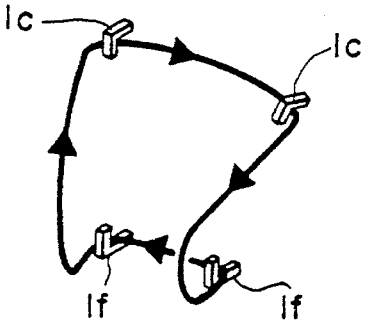
FIG. 13 PRIOR ART
FIG. 13 is a schematic view showing one example of a winding shape of a wire.

The winding apparatus 10 in this embodiment is so constructed as described, and in winding the wire W around the deflection yoke as shown in FIG. 11, the winding operation is performed in such a manner as shown in FIGS. 5 to 10.

Figure 5:
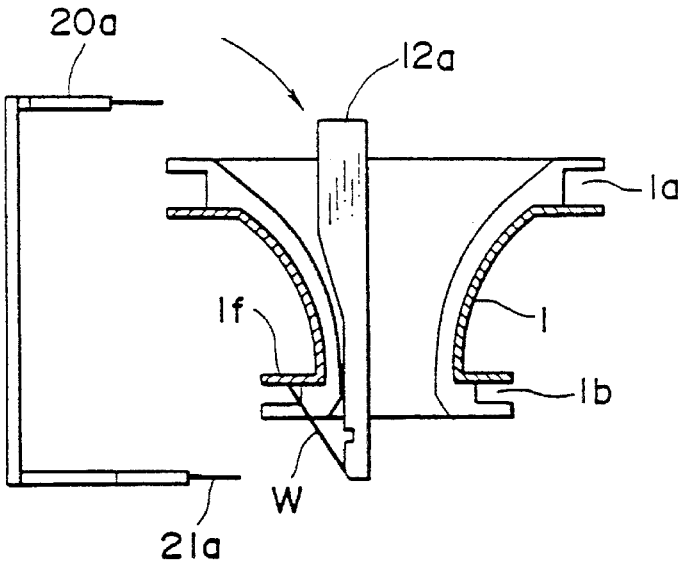
FIG. 5 is a sectional view showing the state of starting the winding of the wire according to the present invention.

First, as shown in FIG. 5, the nozzle 12*a* is descended in the deflection yoke 1, and the wire W is bound and fixed to the section if on the neck side.

Next, as the deflection yoke 1 is rotated while the nozzle 12*a* is ascended, the wire W is supplied along the winding groove 1*d*. Further, the wire W is caught by the guide 20*a*, and is wound around the opening side circumferential groove 1*e* by turning of the deflection yoke 1 (see FIG. 6).

Figure 6:
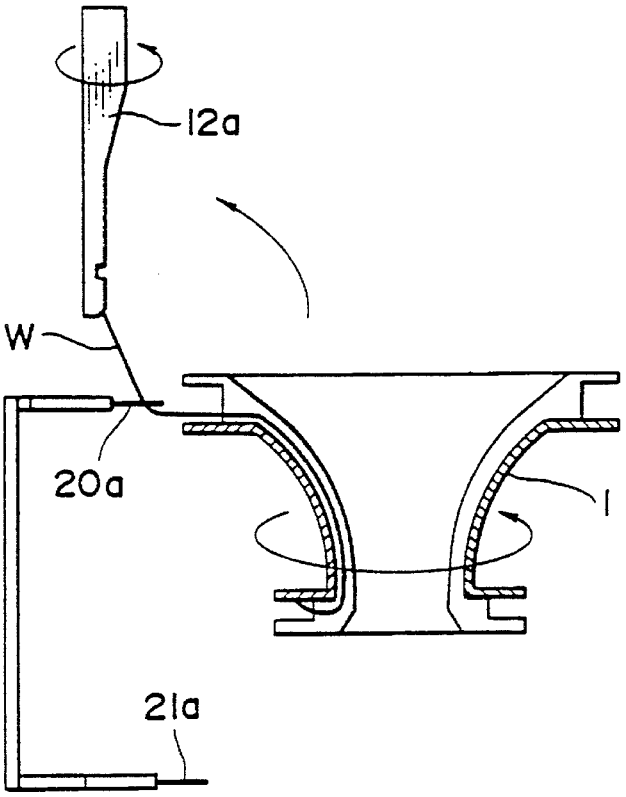
FIG. 6 is a sectional view showing the state where the wire is wound around an opening side circumferential groove of the deflection yoke.

As shown in FIG. 6, when the nozzle 12*a* is moved to the position higher than the opening portion 1*a* of the deflection yoke 1, it is stopped and is turned by 180°. Then, the guide claw 20*a* advances in the open state, and is closed to catch the wire W. Thus, the wire W is moved to the position corresponding to the opening portion side circumferential groove 1*e*.

Figure 7:
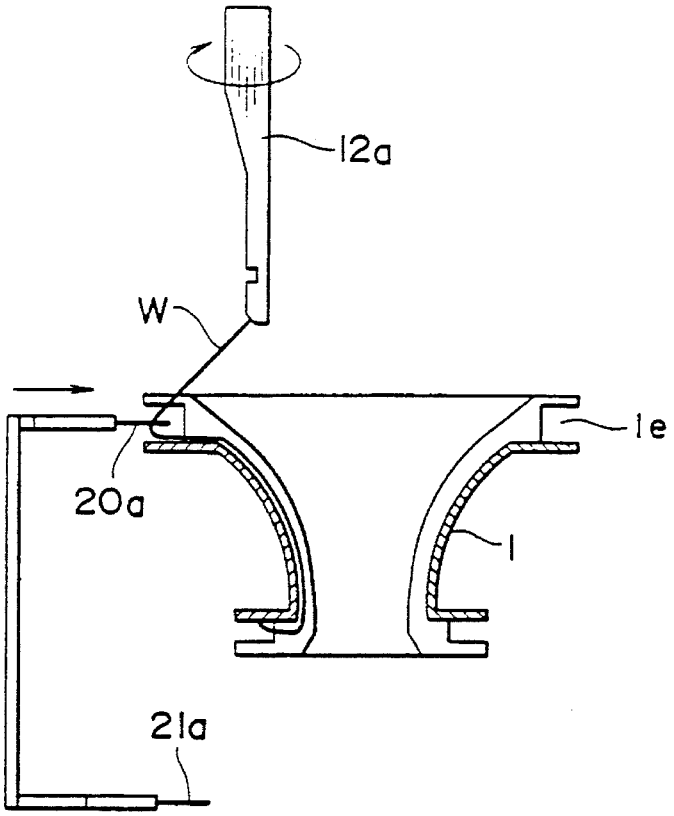
FIG. 7 is a sectional view showing the state where the wire is wound around a certain section.

Next, the deflection yoke 1 is turned, and is stopped at the position of the section 1*c* to be wound with the wire. At this time, as shown in FIG. 7, the guide claw 20*a* advances so as to correspond to the position of the opening portion circumferential groove 1*e*, and enters within the opening portion side circumferential groove 1*e*. Subsequently, the nozzle 12*a* is moved to the inside of the deflection yoke 1 and is turned by minus 180°, to be thus returned to the original position.

Then, by opening of the guide claw 20*a*, the winding of the wire W is performed for the target section 1*c*.

Figure 8:
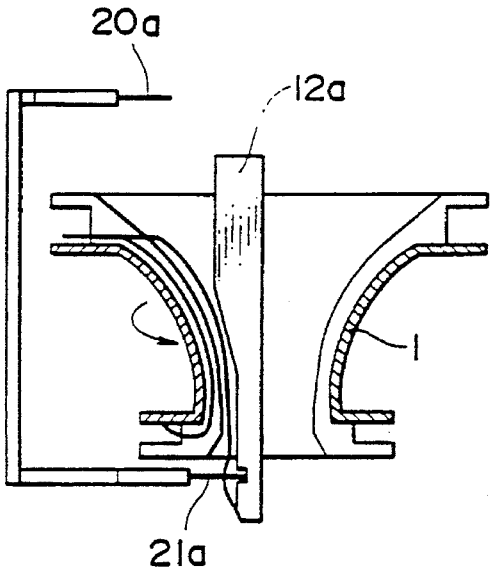
FIG. 8 is a sectional view showing the state where the wire is caught by a guide claw on the neck side.

Next, as shown in FIG. 8, the nozzle 12 is descended while supplying the wire W. Synchronously with the descending of the nozzle 12*a*, the deflection yoke 1 is turned. Thus, the nozzle 12*a* is descended along an arbitrary winding groove 1*d*. When the nozzle 12*a* is descended along the winding groove 1*d* and reaches the minimum point, the guide claw 21*a* advances and is closed to catch the wire W. In such a state, the guide claw 20*a* is retreated and ascended, and as shown in FIG. 9, when reaching the position of the neck side circumferential groove 1*h*, it is stopped. In such a state, the deflection yoke 1 is turned, and the wire W is wound around the neck side circumferential groove 1*h*. The turning of the deflection yoke 1 is stopped at the target section if (see FIG. 9).

At this time, as shown in FIG. 10, the guide claw 21*a* advances while being in the position of the neck side circumferential groove 1*h*, and enters in the inside of the neck side circumferential groove 1*h*. Then, by opening of the guide claw 21*a*, the winding of the wire W is performed for the target section 1*f*.

After that, the guide claw 21*a* is retreated and descended, and further reversed. Further, the nozzle 12*a* is again ascended. By repeating the operational procedure of one cycle described above, the wire W is wound around the deflection yoke 1.

In addition, in the above embodiment, the opening cylinders and the rotary actuators are used for opening/closing and reversing the guide claws 20*a* and 21*a*; however, the opening/closing and reversing means are not limited thereto, for example, the other driving method such as a cam mechanism may be used. Further, in the above embodiment, the ball-screw mechanism is used for the XZ feed unit; however, the driving is possible by the other driving method such as a cylinder, cam and the like.

It is to be understood that the above-described embodiments are merely illustrative of the principles of the invention. Various modifications and changes may be made thereto by those skilled in the art which will embody the principles of the invention and fall within the spirit and scope thereof.

What we claim is:

1. A winding apparatus for a deflection yoke defining an x-axis and a z-axis with the z-axis being coaxial with the deflection yoke and the x-axis being orthogonal to the z-axis comprising;

a base;

a nozzle for supplying a wire to be wound around said deflection yoke;

a tensioner for supplying said wire to said nozzle;

a holder for holding said deflection yoke; and two guide means, each guiding said wire to a different respective vertical position on said deflection yoke.

2. A winding apparatus according to claim 1, wherein each of said guide means is capable of being reversed by 180° about the x-axis.

3. A winding apparatus according to claim 1, wherein said guide means have a common base which is movable in the x-and z- directions and is driven by an x-z feed unit.

4. A winding apparatus according to claim 1, which includes an x-z feed unit for allowing nozzle movement in the x and z directions.

5. A winding method for a deflection yoke defining an x-axis and a z-axis with the z-axis being coaxial with the deflection yoke and the x-axis being orthogonal to the z-axis comprising the steps of:

holding said deflection yoke by a holder;

supplying a wire from a tensioner to a nozzle;

winding said wire supplied from said nozzle around a portion of said deflection yoke to be wound with said wire while guiding said wire with a first guide means; and winding said wire around a different vertical position of said deflection yoke while guiding said wire with a second guide means.

6. A winding method according to claim 5, further comprising the steps of reversing each of said guide means by 180° about the x-axis.

* * * * *